US010056728B2

(12) United States Patent
Conte

(10) Patent No.: US 10,056,728 B2
(45) Date of Patent: Aug. 21, 2018

(54) CABLE PROCESSING APPARATUS FOR TRIMMING, STRIPPING INSULATION FROM AND FITTING CRIMP CONTACTS TO A CABLE

(71) Applicant: Komax Holding AG, Dierikon (CH)

(72) Inventor: Alois Conte, Ebikon (CH)

(73) Assignee: KOMAX HOLDING AG, Dierikon (CH)

( * ) Notice: Subject to any disclaimer, the term of this patent is extended or adjusted under 35 U.S.C. 154(b) by 486 days.

(21) Appl. No.: 14/786,586

(22) PCT Filed: Apr. 9, 2014

(86) PCT No.: PCT/EP2014/057132
§ 371 (c)(1),
(2) Date: Jan. 20, 2016

(87) PCT Pub. No.: WO2014/173682
PCT Pub. Date: Oct. 30, 2014

(65) Prior Publication Data

US 2016/0141821 A1 May 19, 2016

(30) Foreign Application Priority Data

Apr. 24, 2013 (EP) ..... 13165232

(51) Int. Cl.
*H01R 43/05* (2006.01)

(52) U.S. Cl.
CPC ..... *H01R 43/05* (2013.01); *Y10T 29/49181* (2015.01); *Y10T 29/49185* (2015.01);
(Continued)

(58) Field of Classification Search
CPC ..... Y10T 29/49174; Y10T 29/49181; Y10T 29/49183; Y10T 29/49185;
(Continued)

(56) References Cited

U.S. PATENT DOCUMENTS 3,909,900 A 10/1975 Gudmestad
4,361,942 A 12/1982 Mazzola et al.
(Continued)

FOREIGN PATENT DOCUMENTS

CN 130303 C 11/1998
DE 19532010 A1 3/1997
(Continued)

*Primary Examiner* — Peter DungBa Vo
*Assistant Examiner* — Joshua D Anderson
(74) *Attorney, Agent, or Firm* — William J. Clemens; Shumaker, Loop & Kendrick, LLP

(57) ABSTRACT

A cable processing apparatus includes a trimming and insulation stripping unit with cutting blades for severing the cable, first insulation-stripping blades for stripping insulation from a rear end of the severed cable piece, and second insulation-stripping blades for stripping insulation from a front end of the remainder of the cable, and a crimping press with a first crimping tool for connecting the rear end of the trimmed cable piece to a first crimp contact and with a second crimping tool for connecting the front end of the remainder of the cable to a second crimp contact. A lifting element formed by a carriage and displaceably mounted on a machine housing of the cable processing apparatus operate both the trimming and insulation-stripping unit and the first and second crimping tools. The lifting element is moved up and down by an eccentric shaft driven by a motor.

15 Claims, 9 Drawing Sheets

(52) U.S. Cl.
CPC ..... *Y10T 29/49192* (2015.01); *Y10T 29/5142* (2015.01); *Y10T 29/53235* (2015.01)

(58) Field of Classification Search
CPC ..... Y10T 29/49192; Y10T 29/514; Y10T 29/5142; Y10T 29/5145; Y10T 29/5148; Y10T 29/5187; Y10T 29/5193; Y10T 29/53187; Y10T 29/53209; Y10T 29/53213; Y10T 29/53235; H01R 43/048; H01R 43/05; H01R 43/28
See application file for complete search history.

(56) References Cited

U.S. PATENT DOCUMENTS

| | | | | |
|---|---|---|---|---|
| 4,852,241 | A * | 8/1989 | Belaidouni | H01R 43/05 29/564.4 |
| 5,842,266 | A * | 12/1998 | Ishiwata | H01R 43/28 29/564.4 |
| 2002/0029935 | A1 | 3/2002 | Reuter et al. | |

FOREIGN PATENT DOCUMENTS

| | | | |
|---|---|---|---|
| DE | 19539384 | A1 | 4/1997 |
| DE | 19615564 | C1 | 7/1997 |
| EP | 1447888 | A1 | 8/2004 |
| EP | 1515410 | A2 | 3/2005 |
| JP | S4712175 | | 6/1972 |
| JP | H06290845 | A | 10/1994 |
| JP | 2005151778 | A | 6/2005 |

* cited by examiner

CABLE PROCESSING APPARATUS FOR TRIMMING, STRIPPING INSULATION FROM AND FITTING CRIMP CONTACTS TO A CABLE

FIELD

The invention relates to cable processing apparatus for cutting a cable to length and stripping insulation therefrom and for fitting out the cable with crimp contacts.

BACKGROUND

By "crimping" there is to be understood the production of a non-detachable electrical and mechanical connection (crimp connection) by plastic deformation between a conductor and a crimp contact. Cable processing apparatus for processing of electric cables, in which the cable is cut to length and stripped of insulation and then a crimp contact is applied to the stripped conductor end of the cable in a crimping station, have been known for a long time and are customary. EP 1 447 888 A1 shows, for example, cable processing apparatus with a unit for cutting to length and stripping insulation and two stations with crimping presses. The apparatus further includes cable advancing means, constructed as a belt drive, for movement of the cable along a longitudinal axis. The unit for cutting to length and stripping insulation is arranged on the longitudinal axis. However, since the two crimping stations are disposed near the longitudinal axis, the cable has to be guided to the respective crimping presses by means of pivot arms provided with grippers. In that case, the leading cable end is equipped with a crimp contact in the first crimping press and the trailing cable end is equipped with a crimp contact in the second crimping press.

Comparable cable processing apparatus according to category has become known from U.S. Pat. No. 4,361,942, in which the unit for cutting to length and stripping insulation and the two crimping tools for connecting the rear and front ends of the severed cables stripped of insulation are arranged on a line. The unit for cutting to length and stripping insulation as well as the crimping tools are moved by means of respective cam discs. The drive concept shown in U.S. Pat. No. 4,361,942 has little flexibility and adaptations to different cable thicknesses and kinds of crimping are hardly possible. The machine, which is of complicated construction, additionally requires a large amount of space.

SUMMARY

It is accordingly an object of the invention to create cable processing apparatus of the kind stated in the introduction which can operated simply and efficiently. The cable processing apparatus shall be distinguished by a high level of flexibility with respect to varying cables and crimp connections.

These objects are fulfilled by the crimping station with a unit for cutting to length and stripping insulation that comprises, for the cutting to length, at least one knife for severing the cable. During cutting the cable to length by means of the at least one knife a piece of cable cut to length and a cable remainder shortened by the cable piece arise. Subsequently, a rear end of the separated cable (cable piece cut to length) can be stripped of insulation by the at least one knife and finally a front end of the cable (cable remainder). Obviously, the sequence of the two steps of stripping insulation can also be reversed (i.e. initially cable remainder, then cable piece cut to length). However, it can be advantageous if different knives are used for the cutting to length and stripping insulation. The unit for cutting to length and stripping insulation can preferably comprise at least one separating knife for severing the cable. When the cable is cut to length by means of the cutting knife or knives a cable piece cut to length and a cable remainder shortened by the cable piece result. The unit for cutting to length and stripping insulation further comprises at least one first insulation stripping knife for stripping insulation from a rear end of the cable severed by the separating knife or knives (cable piece cut to length) and at least one second insulation stripping knife for stripping insulation from the front end of the cable (cable remainder). The arrangement with the plurality of knives has the advantage that the two cable ends can be cut into simultaneously, as a first step of the essentially two-stage insulation stripping process, which additionally includes drawing off the insulation. The cable processing apparatus then comprises a crimping press with a first crimping tool for connecting the rear or trailing end of the cable piece, which is cut to length and stripped of insulation, with a first crimp contact and a second crimping tool for connecting the front end of the cable remainder, which is stripped of insulation, with a second crimp contact. The crimping tools can be each of two-part construction, wherein one part is designed to be movable or mobile and includes a single-part or multi-part crimping die and the other part is preferably designed to be stationary and includes the mating member for the crimping die (anvil). The movable part of the respective crimping tool is termed upper tool in the following; the preferably stationary part of the respective crimping tool is termed lower tool in the following. The mentioned unit for cutting to length and stripping insulation as well as the two crimping tools of the crimping press form the three essential processing components of the cable processing apparatus.

Due to the fact that the cable processing apparatus comprises a stroke element, which is movable translationally and preferably in vertical direction by means of a drive unit, and at least two of the three processing components are operable by way of the stroke element, an economic cable processing apparatus is created, which is of simple construction and capable of flexible use. Thus, all essential processing steps which have to be undertaken at the cable in vertical direction can be executed solely by movement of the stroke element. The operative connection between stroke element and unit for cutting to length and stripping insulation in that case, however, advantageously refers merely to the cutting processes for the cutting to length and insulation stripping. The drawing-off process, in which the cut-into insulation is removed from the cable, can be carried out, for example, in a manner known per se by means of horizontally movable grippers. Through the use of such a stroke element for the cutting processes for the cutting to length and stripping of insulation and for the crimping it is also possible to create compact apparatus which is distinguished by a low need for space. Various drive solutions are conceivable for moving the stroke element. Apart from a motor-drivable eccentric shaft, the stroke element could also be moved by, for example, a spindle drive or a toggle-lever mechanism.

The cable processing apparatus is preferably designed in such a way that the unit for cutting to length and stripping insulation and the first crimping tool and second crimping tool of the crimping press are operable by way of the stroke element. If all three processing components are operable by way of the vertically movable stroke element the cable processing apparatus can be operated particularly efficiently.

The crimping press can comprise a lowering device for positioning the cable during crimping, wherein the lowering device is equally movable by way of the stroke element (for example through fastening of the lowering device to the stroke element).

The first crimping tool and the second crimping tool can each comprise respective movable upper tools, preferably equipped with crimping dies, wherein the upper tools are fastened or fastenable to the stroke element. The crimping die can, in known mode and manner, be of two-part construction for producing the insulation and wire crimp. As mating member for the mentioned upper tools the cable processing apparatus can preferably comprise lower tools which are equipped with anvils and which, at least for the fitting-out process, are mounted in the cable processing apparatus to be immovable. Alternatively, for specific cases of use it would even be conceivable to also design the lower tools to be movable. In this case, the lower tools could be so connected with the upper tools by way of a transmission that they are movable in vertical direction in opposite sense. This variant would have the advantage that the cable would not have to be lowered during the crimping for positioning of the cable ends stripped of insulation.

It can be advantageous for flexible use of the cable processing apparatus if the stroke element comprises two lateral tool mounts into which the upper tools are inserted or insertable from opposite sides preferably to be mechanically positively coupled. The insert direction for insertion of the upper tools consequently extends transversely (thus, horizontally) to the stroke direction of the stroke element. Through the simple mounting and demounting of the upper tools it is possible to shorten shutdown times during change to different cables or crimp contacts. The cable processing apparatus can additionally comprise lower tools which are inserted or insertable in similar manner into corresponding mounts.

The stroke element can, with particular advantage, be formed by a carriage, wherein the carriage is displaceably mounted on a machine housing of the cable processing apparatus by means of a guide arrangement. Carriage constructions of that kind are translationally movable in particularly simple manner.

In a particularly advantageous form of embodiment the cable processing apparatus can be designed as a linear machine. If the cable is transportable along a longitudinal axis by the cable processing apparatus it can be advantageous if the unit for cutting to length and stripping insulation as well as the first crimping tool and second crimping tool of the crimping press are arranged in succession along the longitudinal axis 'in a line'. The unit for cutting to length and stripping insulation can in that case be arranged between the first and second crimping tools with respect to the conveying direction or longitudinal axis.

The cable processing apparatus can comprise a motor-drivable eccentric shaft by which the stroke element is reciprocatingly movable between a start setting and a crimping setting. The stroke element can have a bearing opening in which an end of the eccentric shaft is received. The different operational settings of the cable processing apparatus can be controlled in particularly simple and precise manner by way of the eccentric shaft. For driving the eccentric shaft, the cable processing apparatus can comprise a setting motor which is connected with the eccentric shaft directly or via a transmission.

The unit for cutting to length and stripping insulation can, for severing the cable, comprise mutually opposite upper and lower separating knives and, for stripping insulation from the cable, mutually opposite upper and lower insulation stripping knives and mutually opposite upper and lower second insulation stripping knives, wherein the respective upper and lower separating knives or insulation stripping knives are movable in opposite sense with respect to one another. The cutting operation can be carried out in efficient manner by the respective paired arrangement of the knives.

An upper knife unit comprising the upper separating knife, the upper first insulation stripping knife and the upper second insulation stripping knife can preferably be rigidly connected with the stroke element. This rigid connection can be created, for example, by a screw connection. However, obviously other forms of connection for creating the rigid connection would also be conceivable. A lower knife unit comprising the lower separating knife, the lower first insulation stripping knife and the lower second insulation stripping knife can be so connected with the stroke element in terms of transmission that when the upper knife unit is lowered, the lower knife unit is raised or moved in opposite direction. For this operative connection, for example, racks connected together by way of a pinion can be associated with the upper knife unit and the lower knife unit.

The cutting to length and stripping of insulation can be further improved if the at least one separating knife, the at least one first insulation stripping knife and the at least one second insulation stripping knife each have V-shaped cutters.

It can additionally be advantageous if the cable processing apparatus comprises a withdrawal gripper, which is movable along a longitudinal axis, for transporting the cable at the entry side to a position for cutting to length. However, other conveying means such as, for example, a belt drive are also conceivable in place of a withdrawal gripper.

The cable processing apparatus can comprise two drawing-off grippers for stripping insulation, by each of which the parts, which are not stripped of insulation, of the rear and front ends of the cable (in other words those parts of the cable in which the insulation is to remain) can be gripped and moved. The drawing-off grippers can be movable along the longitudinal axis. Separate drives or possibly even a common drive can be used for movement of the drawing-off grippers.

A first drawing-off gripper is associated with the rear end of the cable piece cut to length and a drawing-off gripper associated with the front end of the rest of the cable can form a drawing-off unit which is fastened to a machine housing of the cable processing apparatus or to another stationary component of the cable processing apparatus.

Two lowering devices for vertical positioning of the cable ends in the crimping press can preferably be arranged at the stroke element, wherein the drawing-off grippers gripping the cable stripped of insulation are movable between a start setting and a crimping setting by the lowering devices during movement of the stroke element. With the help of the lowering devices as positioning units, which, for example, comprise vertically extending rams, the respective pulling-off grippers are moved between a start setting and a crimping setting for movement of the stroke element during the crimping process. The lowering devices can produce the desired movement of the grippers by, for example, abutting against or other form of action on drawing-off grippers temporarily fixing the cable ends.

Moreover, it can be advantageous if for vertical positioning of the cable ends for the crimping process the drawing-off grippers are mounted in the drawing-off unit to be movable in vertical direction. Moreover, the drawing-off unit can comprise a cable guide, which is preferably associated with the second drawing-off gripper, for introduction of a cable at the entry side.

The invention could also be directed to a method of operating the crimping station described in the foregoing. The method is distinguished by the fact that, in particular, the at least two of the three—and particularly preferably all three—previously described processing components can be vertically moved into the respective operating positions with use of a stroke element movable in vertical direction.

DESCRIPTION OF THE DRAWINGS

Further individual features and advantages of the invention are evident from the following description of embodiments and from the drawings, in which.

DETAILED DESCRIPTION

Figure 1:
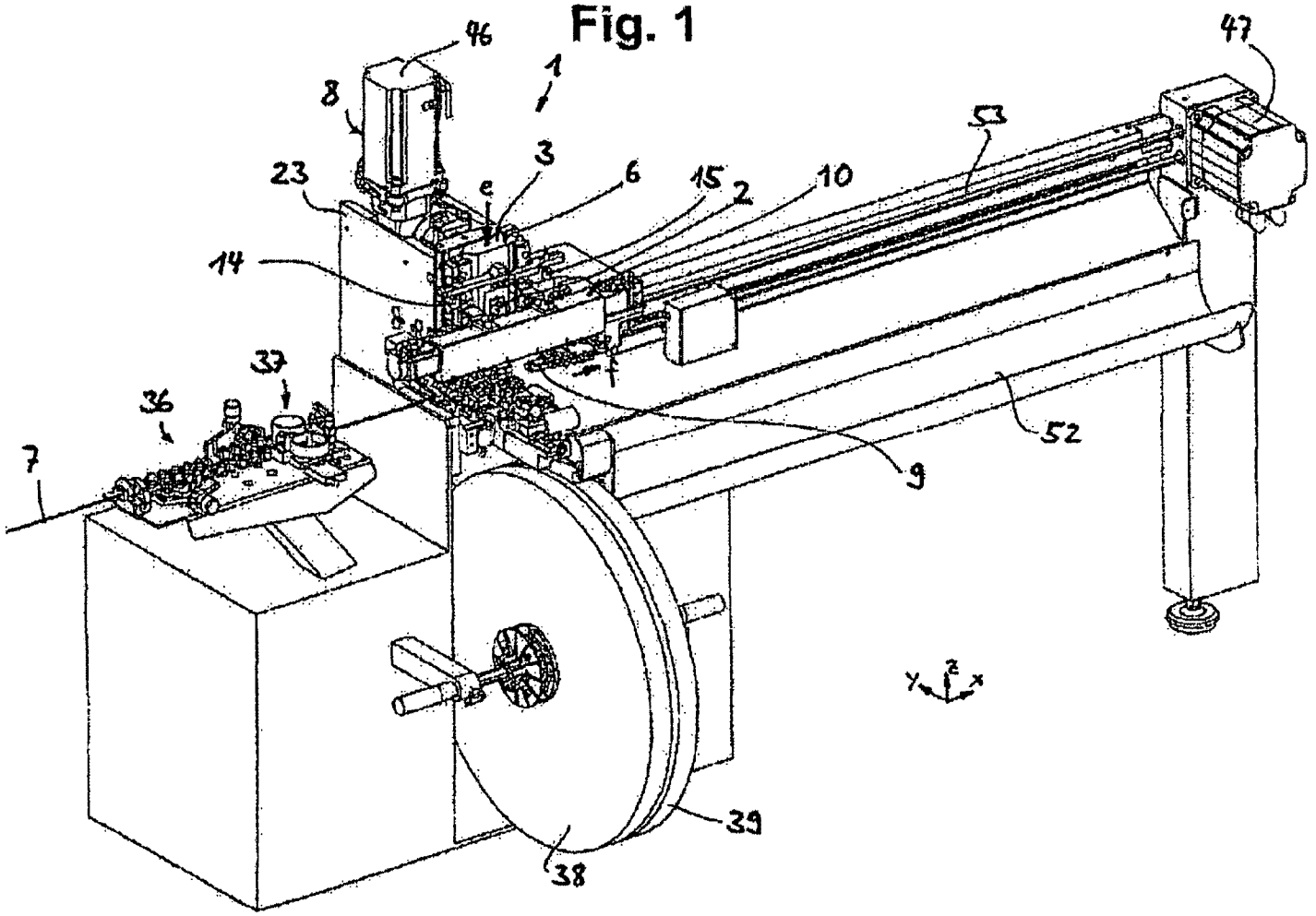
FIG. 1 shows a perspective illustration of a plant with a cable processing apparatus according to the invention.

FIG. 1 shows plant for processing cables by a cable processing apparatus, which is denoted by 1, for cutting the cable 7 to length and stripping insulation therefrom and for fitting out the cable with crimp contacts. It is possible by the apparatus described in the following to process electrical cables comprising a conductor and insulation encasing the conductor. However, the apparatus could also be suitable for cables with several cable cores. The cable 7 is withdrawn by a straightening device 36 and by means of a withdrawal gripper 9 to the desired length. The withdrawal gripper 9 is mounted on a linear guide and can be reciprocatingly moved along the x-axis by way of a belt 53 driven by a motor 47. The conveying device for transport of the cable through the cable processing apparatus 1 is indicated by an arrow f. The plant further comprises a length measuring unit 37 by which the cable length can be checked during withdrawal of the cable and the withdrawal gripper 9 activated.

Figure 2:
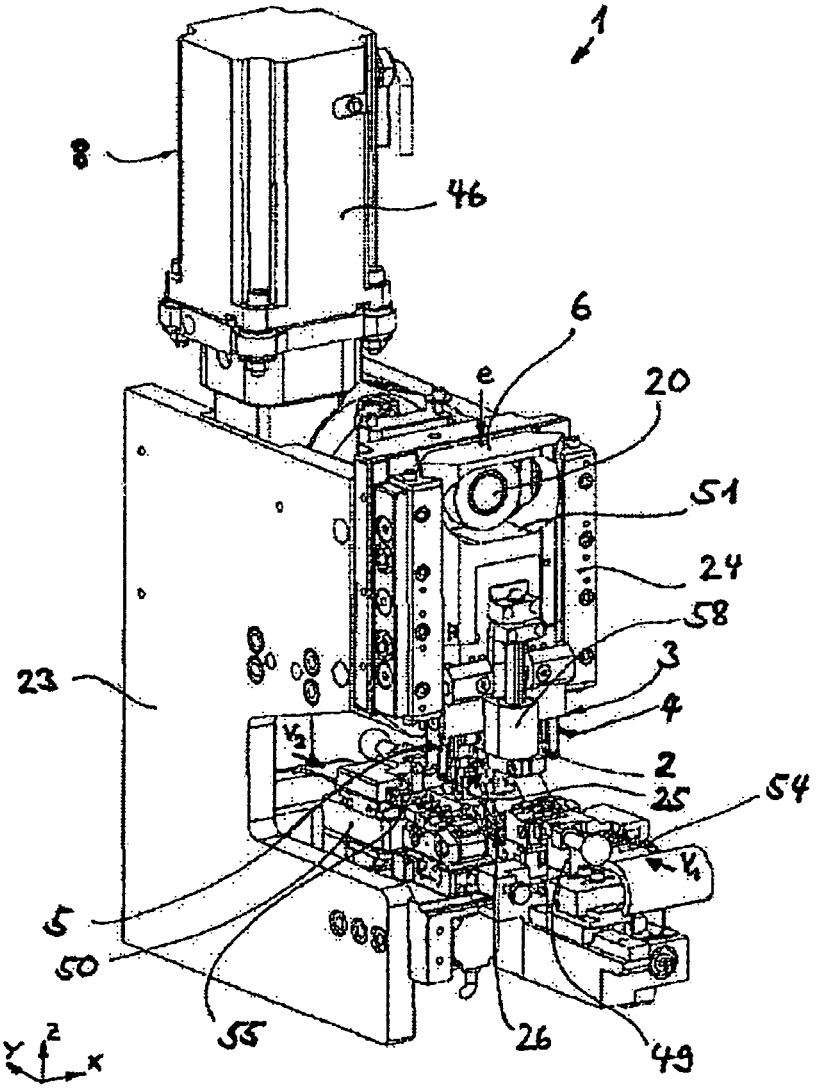
FIG. 2 shows the cable processing apparatus of FIG. 1 in a somewhat modified illustration.

The cable processing apparatus 1 comprises a cutting-to-length and insulation-stripping unit 2 for cutting the cable 7 to length and stripping insulation therefrom. The cable processing apparatus comprises a crimping press 3 by which the stripped conductor ends of the cable, which is present after severing of the cable, can be connected with crimp contacts. The crimping press 3 comprises a carriage 6 drivable by means of a motor 46 and movable up and down in the vertical direction z. The carriage 6 forms a stroke element, by way of which not only the crimping press 3 is operable, but also by way of which the unit 2 for cutting to length and stripping insulation is operable. The stroke element 6 is displaceably mounted at the machine housing 23 of the cable processing apparatus 1 at vertical guides 24 (FIG. 2). The lowering movement of the stroke element 6 is indicated by an arrow e.

During the cutting to length and stripping of insulation by the unit 2, two conductor ends stripped of insulation are created at the same time. A respective crimping tool is associated with each stripped conductor end. The two crimping tools of the crimping press 3 are so operatively connected with the stroke element 6 that on lowering of the stroke element in the e-direction the two mutually opposite conductor ends can be simultaneously furnished with crimp contacts. The unit 2 for cutting to length and stripping insulation and the two crimping tools of the crimping press 3 thus do not have individual drives, but can be moved up and down in common by a drive unit 8. The drive unit 8 substantially consists of the motor 46, which preferably has the configuration of a servomotor or setting motor and which preferably has, for example, vertical orientation, an angle transmission and an eccentric shaft operatively connected with the stroke element 6. The drive unit 8 is provided with regulating and control elements and measuring systems in order to be able to position the stroke element with a high degree of precision. The drive solution with the eccentric shaft is producible simply and economically, is robust and nevertheless guarantees precise positioning of the stroke element. However, instead of the drive unit 8, which is shown here, with the eccentric shaft, other drive solutions for vertical movement of the stroke element would also be conceivable. Possible variants would be, for example, spindle drives or toggle levers.

The cable processing apparatus 1 is designed as a linear machine. The cable 7 is transportable along the longitudinal axis x by the cable processing apparatus 1; the unit 2 for cutting to length and stripping insulation as well as the first crimping tool 4 and the second crimping tool 5 of the crimping press 3 are arranged in succession along the longitudinal axis (FIG. 2). In the case of the linear arrangement the cable remains, in all operating positions, substantially on the longitudinal axis x or at least in a parallel position or alignment with respect to the longitudinal axis.

The plant then comprises two storage rolls 38, 39 with strips, which are wound thereon, with crimp contacts arranged in a row. The contact strips 54, 55 (FIG. 2) are led to the crimping press 3 transversely to the longitudinal axis x. The feed direction for the crimp contacts is indicated by the arrows v1 and v2 (FIG. 2). The storage rolls 38, 39 are mounted in a machine frame of the plant to be rotatable. The cables produced to finished state are deposited in a trough-shaped cable deposit 52.

The stroke element 6 is illustrated partly broken away in FIG. 2 for better understanding of the construction and mode of operation of the cable processing apparatus, so that the eccentric shaft 20 mounted in the bearing opening 51 can be seen. In addition, in FIG. 2 the lowering device (cf. following FIG. 3) as well as the drawing-off unit have been rendered invisible. The stroke element 6 is disposed in an uppermost setting, which corresponds with a start setting, in FIG. 2. Arranged below the stroke element 6 are the two contact advance units 49, 50 which mount the respective lower tools of the crimping tools 4, 5. The crimp contacts to be processed are components of the contact strips 54 and 55, which can be advanced by means of the contact advance units 49, 50. Advance motors drive the contact advancing devices 18, 19. Contact advancing units of that kind have been made known from, for example, EP 1 764 884 A1. The unit 2 for cutting to length and stripping insulation comprises an upper knife unit 25 equipped with two insulation stripping knives and a separating knife and an identically constructed lower knife unit 26. The upper knife unit 25 is fastened to the stroke element 6, and the lower knife unit 26 is connected by a transmission with the stroke element 6 so that on lowering of the upper knife unit 25 the lower knife unit 26 is simultaneously raised. The crimping press 3 comprises a first crimping tool 4 for connecting the rear end of the cable piece, which is cut to length and stripped of insulation, with a first crimp contact, wherein the first crimp contact derives from the cable strip 54. The second crimping tool 5 connects the front end of the stripped cable remainder with a second crimp contact. The second crimp contacts are stored on the second storage roll (not shown here) with the second cable strip 54.

Figure 3:
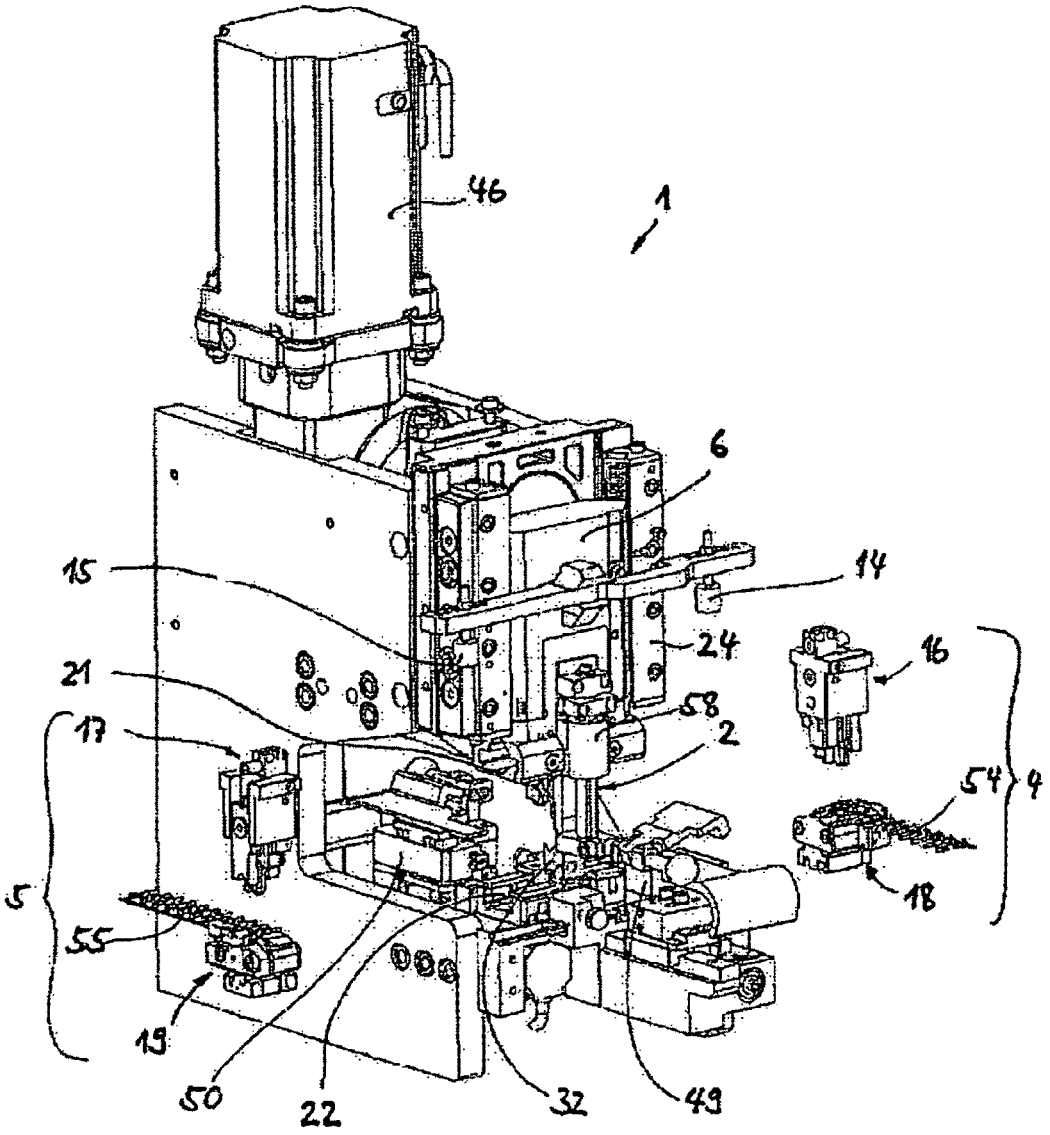
FIG. 3 shows the cable processing apparatus with demounted upper tools and lower tools of a crimping press.

The contact advancing units 49, 50 with inserted lower tools are illustrated in FIG. 2, whereas these are illustrated in the following FIG. 3 lying beside one another for the purpose of, for example, tool change. FIG. 3 shows the cable processing apparatus 1 with a stroke element 6 lowered to such an extent that the upper tools and lower tools of the crimping press could be demounted. The upper tool of the first crimping tool 4 for crimping the rear end of the cable is denoted by the reference numeral 16 and is also termed first upper tool in the following. The second upper tool 17 is associated with the front end of the cable. The upper tools 16, 17 are respectively insertable into corresponding lateral tool mounts 21. The upper tools can, as evident, be inserted into the complementary tool mounts 21 from opposite sides. The two upper tools 16 and 17 are fastened to the vertically movable stroke element 6 and are thus designed to be movable. Through the direct coupling of the upper tools to the stroke element the upper tools are moved in the same direction and through the same stroke as the stroke element. The contact advancing devices 18, 19 forming two lower tools, i.e. the first lower tool 18 and the second lower tool 19, are insertable into tool mounts 22 in similar manner. The tool mounts 22 for the lower tools are rigidly connected with a machine table of the apparatus 1. The drawing-off grippers of the drawing-off unit (not shown here) for the crimping process can be positioned in vertical direction by the lowering devices 14, 15, which are fixedly connected with the stroke element. With the help of the lowering devices 14, 15 the drawing-off grippers, which during the crimping process grip the cable stripped of insulation, are movable between a start setting and a crimping setting when the stroke element 6 is moved.

Since the two cable ends stripped of insulation are crimped conjunctively, it can be necessary for specific applications for the crimping height, which results from the minimum spacing of the respective upper tool from the corresponding lower tool, to be separately adjustable for each cable end. The cable processing apparatus can for that purpose comprise an adjusting mechanism which is, for example, manually actuable (not illustrated in the figures) and by which the die positions in the upper tools 16, 17 or the vertical position of the tool mounts 22 at the stroke element 6 is or are settable. It would also be conceivable to design the adjustment of the crimping heights to be automatic and programmable, wherein the cable processing apparatus could for this case comprise, for example, a motorized adjustment of the tool mount in the stroke element 6 or a motorized lowering or raising of the contact advancing units.

Figure 4:
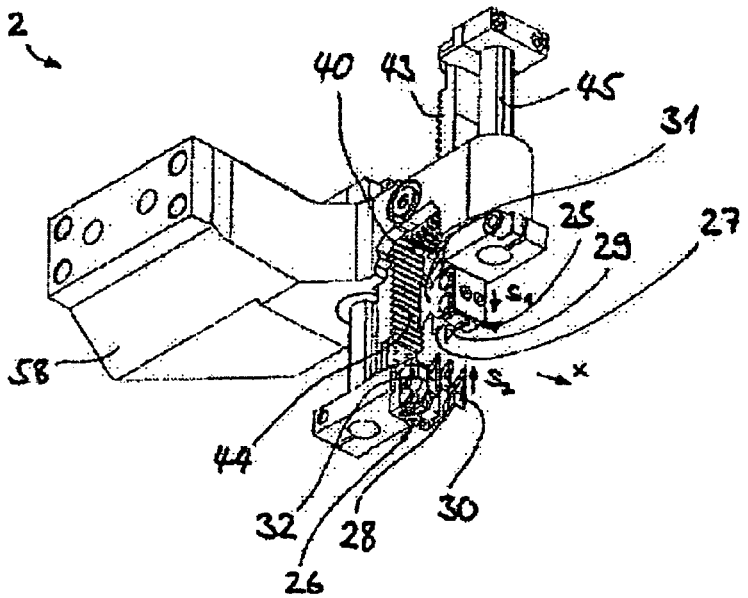
FIG. 4 shows a unit for cutting to length and stripping insulation for the processing apparatus according to FIG. 1.

FIG. 4 shows a unit for cutting to length and stripping insulation with upper knives 27, 29, 31 and lower knives 28, 30, 32 for cutting the cable to length and stripping insulation therefrom. All knives 27, 28, 29, 30, 31, 32 are constructed as so-called V knives, which have V-shaped cutters enabling clean severing or incision for any cable cross-sections. As evident, each knife has V-shaped cutters on both sides, so that the knives can be rotated and reinserted when they are worn. The respective upper and lower knives are combined to form upper and lower knife units 25, 26. The upper knife unit 25 is moved downwardly during lowering of the stroke element (not illustrated here), whilst at the same time the lower knife unit 26 moves upwardly. This closing movement is indicated by arrows s1 and s2. The knife units 25, 26 are respectively fastened to racks 43, 44. The two racks 43 and 44 are connected together by way of a pinion 40, which is formed by a gearwheel, for a capability of movement in opposite sense. The pinion 40 rotatably arranged in the knife head housing 58 between the two racks 43, 44 engages in the two racks and has the effect that the knives of the lower knife unit 26 move through the same path as, but in opposite direction to, the upper knives of the upper knife unit 25. Guide rods 45 ensure that the respective knife units are guided precisely in vertical direction. The subassembly containing the upper knife unit 25 with the rack 43 and the guide rod 45 is rigidly connected with the stroke element (for example by way of a screw connection). A knife head housing 58, to which the pinion 40 is rotatably mounted, is rigidly connected with the machine housing (not illustrated) of the cable processing apparatus and thus constructed to be stationary.

Figure 5:
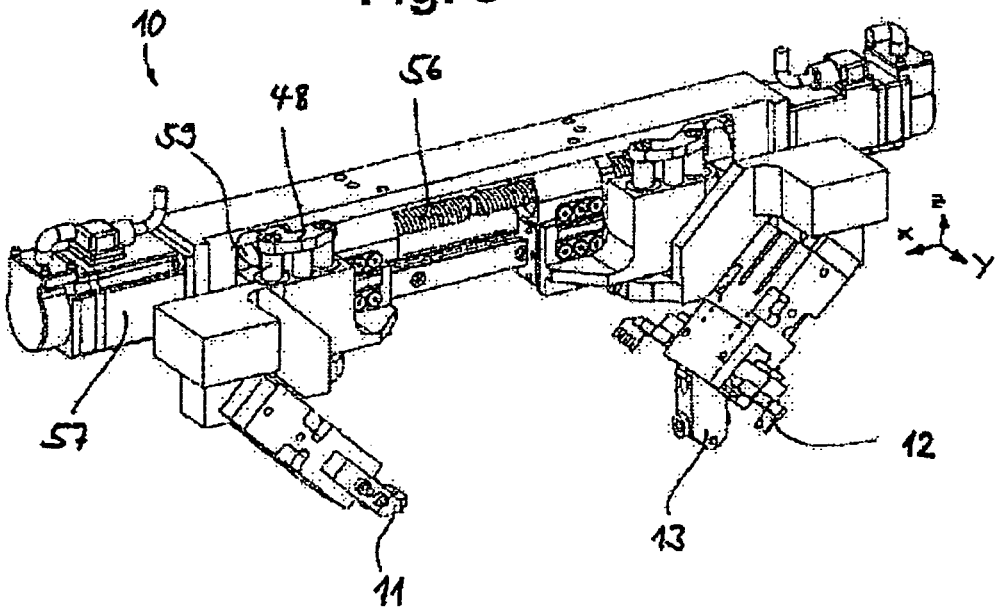
FIG. 5 shows a drawing-off unit for the processing apparatus.

For stripping the insulation the insulation cut into by the insulation stripping knives has to be drawn off the cable ends. A drawing-off unit for performing this work step is shown in FIG. 5. The drawing-off unit 10 comprises two drawing-off grippers 11 and 12 reciprocatingly movable along the longitudinal axis x. The grippers 11, 12 each comprise a gripper head with oppositely movable gripper fingers for gripping the cable. The gripper fingers could, for example, be pneumatically actuable. In FIG. 5, the first drawing-off gripper, which is denoted by 11 and which is associated with the rear end of the cable piece cut to length or to be cut to length, is disposed in an open setting (gripper fingers pivoted apart); the second drawing-off gripper, which is denoted by 12 and which is associated with the front end of the cable 7, is in an activated setting (gripper fingers are closed and would fix the cable by clamping). The drawing-off grippers 11, 12 are mounted to be horizontally displaceable on a common linear guide and can be positioned independently of one another by means of motors 57 and spindles 56.

Since the drawing-off grippers 11, 12 fix the cable ends during the crimping, they have to able to be lowered. The drawing-off grippers 11 and 12 are, for that purpose, mounted to each be capable of limited displacement in vertical direction so that they can be brought by the lowering devices into the correct vertical position in the crimping process. Thanks to the guide rods 59, a precise vertical guidance for the drawing-off grippers 11, 12 is guaranteed. An abutment surface for one lowering device is denoted by 48. Compression springs (not shown) produce a biasing force and hold each of the drawing-off grippers 11, 12 in an upper rest setting when they are not lowered. The drawing-off unit 10 then comprises a cable guide 13, which is associated with the second drawing-off gripper 12 for introduction of the cable 7 at the entry side. The cable guide 13 is substantially formed by a passage hole.

Figure 6:
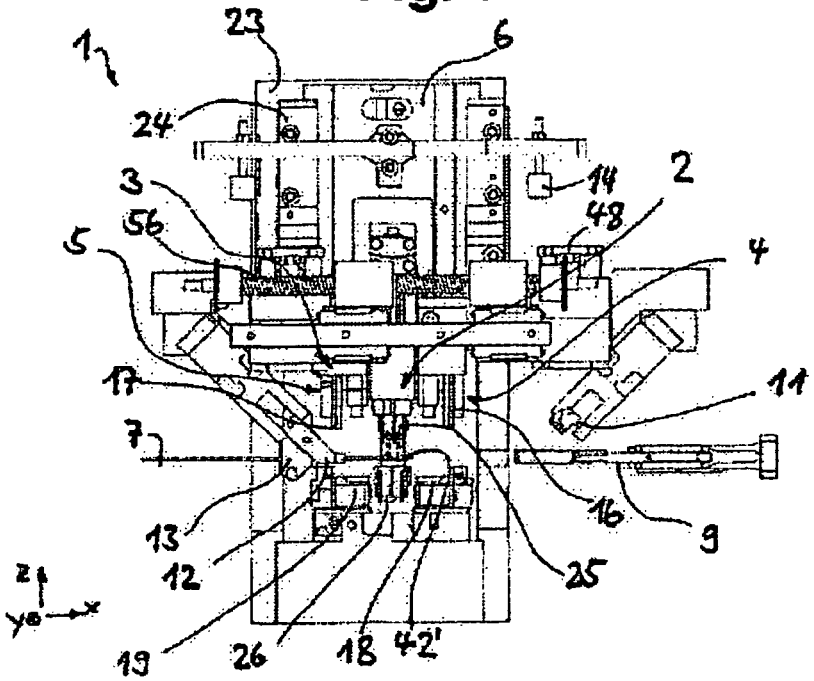
FIG. 6 shows a side view of the processing apparatus in a first operating position with a unit for cutting to length and stripping insulation and a crimping press, in a start setting.
Figure 7:
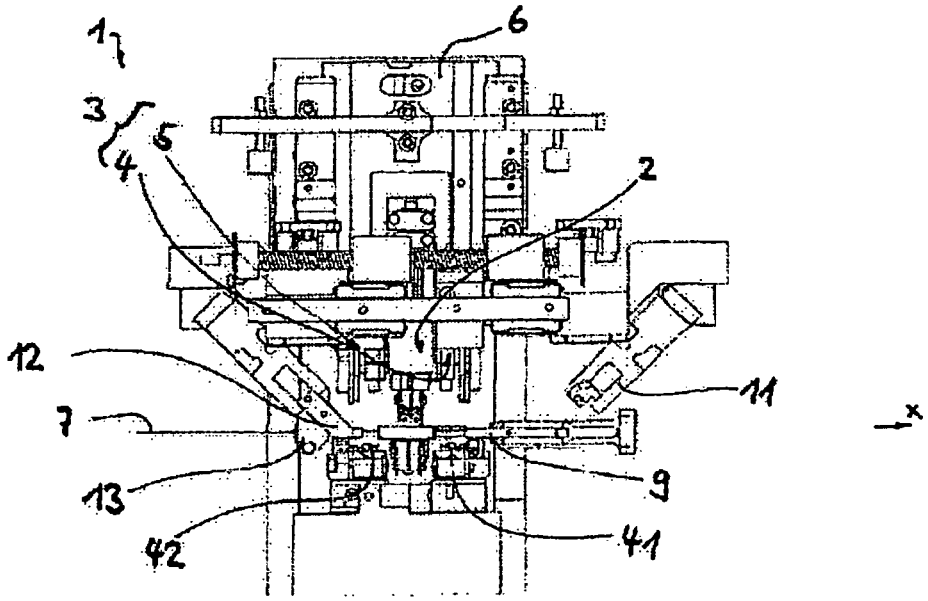
FIG. 7 shows the cable processing apparatus of FIG. 6, but with a moved-in withdrawal gripper.
Figure 8:
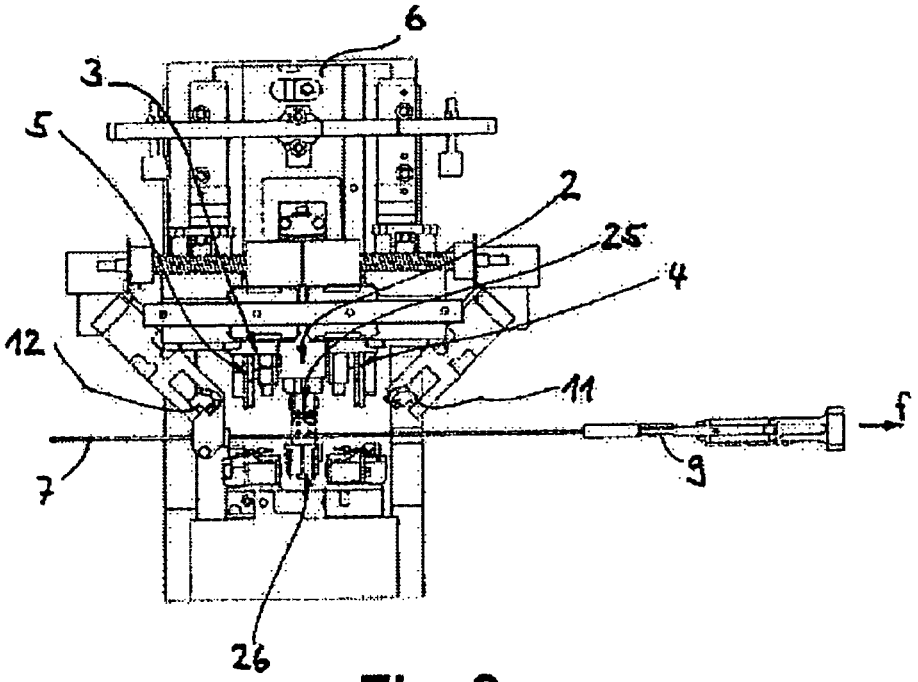
FIG. 8 shows the cable processing apparatus after withdrawal of the cable to a position for cutting to length.
Figure 9:
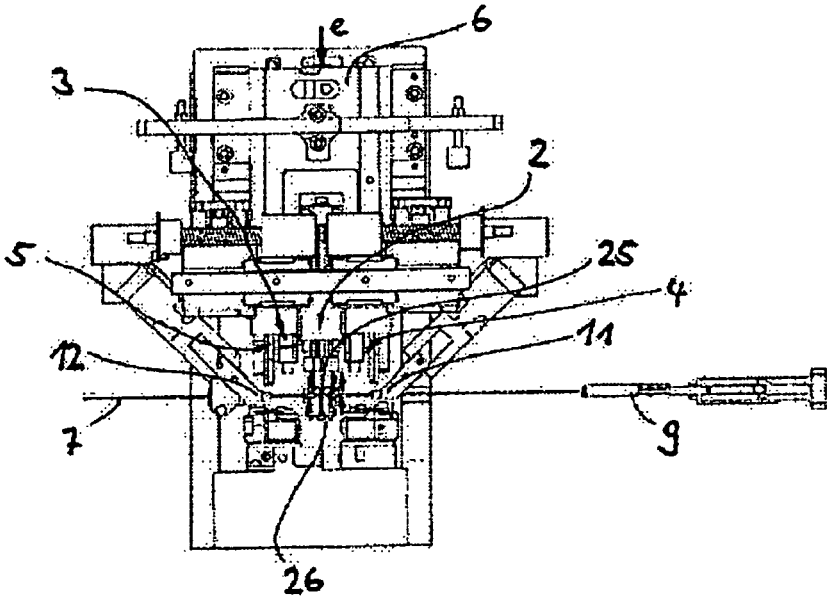
FIG. 9 shows the cable processing apparatus during severing of the cable.
Figure 10:
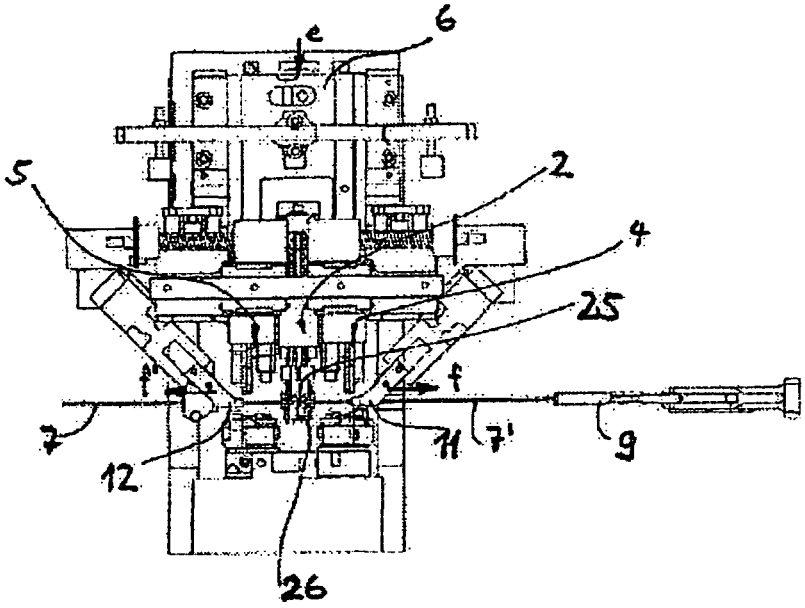
FIG. 10 shows the cable processing apparatus after cutting into the cable for the stripping of insulation.
Figure 11:
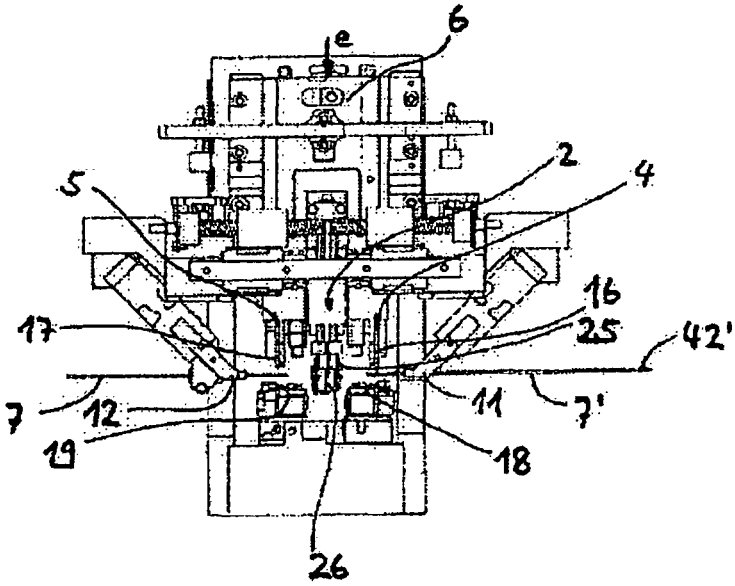
FIG. 11 shows the cable processing apparatus after the end of the insulation stripping process.
Figure 12:
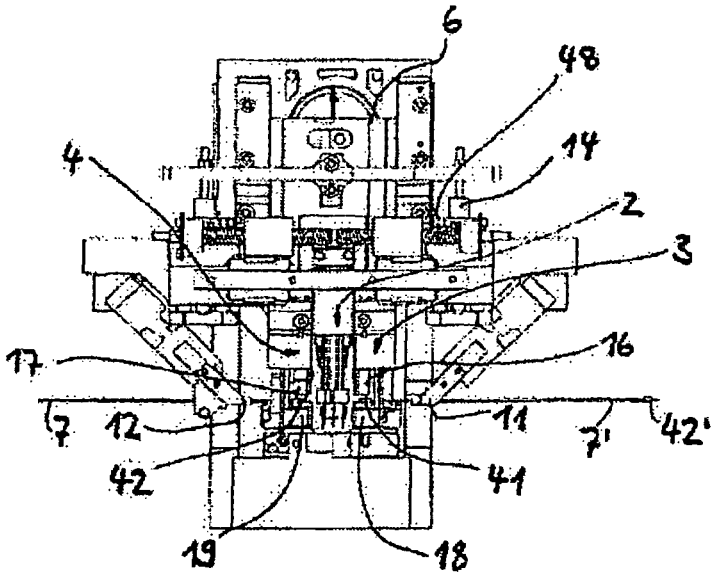
FIG. 12 shows the cable processing apparatus in a crimping setting.
Figure 13:
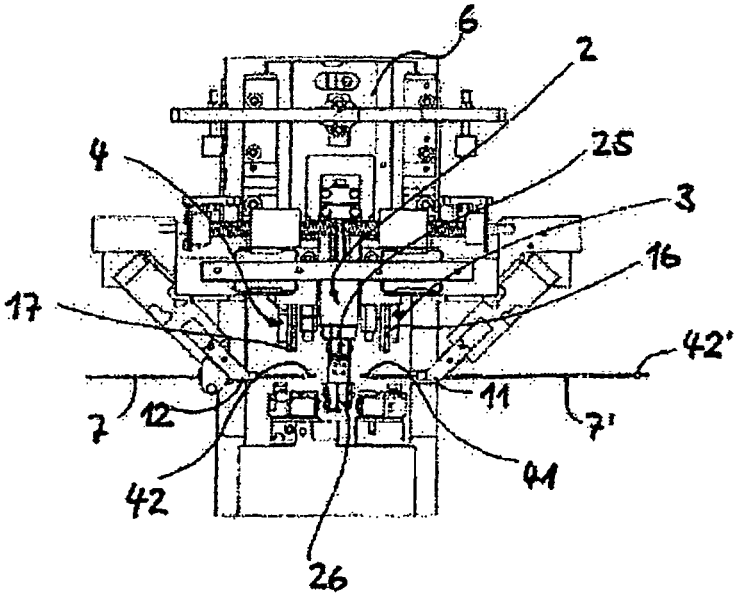
FIG. 13 shows the cable processing apparatus in a next operating setting, in which the unit for cutting to length and stripping insulation and the crimping press are back in the start setting.

The method of operating the cable processing apparatus 1 is illustrated in FIGS. 6 to 13. FIG. 6 shows the cable processing apparatus 1 in a start setting. In the start setting the stroke element 6 is disposed in the uppermost vertical position. This start setting corresponds with the top dead center of the eccentric shaft (not illustrated here). The upper and lower knife units 25, 26 of the unit 2 for cutting to length and stripping insulation and the respective crimping tools 4, 5 are each opened to maximum extent. It is additionally apparent from FIG. 6 that the leading end of an already processed cable 7 has already been provided with a crimp contact 42' and is held by the second drawing-off gripper 12. The second drawing-off gripper 12 has been moved, after the preceding crimping process, in x-direction along the longitudinal axis so that the end of the cable 7 is freed to such an extent that it can be gripped in simple manner by the withdrawal gripper 9. This operating position is illustrated in FIG. 7. The withdrawal gripper 9 has been moved over the stationary cable end and grips the cable behind the crimp contact (FIG. 7). The cable is now drawn out to the desired length by movement of the withdrawal gripper in axial direction x in the conveying direction indicated by the arrow f. This linear movement can be controlled by the length measuring system illustrated by way of example in FIG. 1. The cable processing apparatus 1 is illustrated in FIG. 8 after the conclusion of the withdrawal movement. When the desired cable length is reached, the two drawing-off grippers 11 and 12 close. The stroke element 6 is then, starting from the uppermost position, moved through a first path in downward direction into a separating setting (arrow e), in which the cable is severed by the separating knives 27, 28 of the unit 2 for cutting to length and stripping insulation. FIG. 9 shows the cable processing apparatus with the stroke element 6 in this separating setting. Further details are inferrable from FIG. 14. A cable piece cut to length and denoted by 7' results from severing of the cable. The withdrawal grippers 11, 12 remain in closed setting and fix the respective cable, i.e. the cable piece 7' and the remaining cable 7 shortened by this cable piece. The two drawing-off grippers 11, 12 travel along the longitudinal axis x away from one another into a horizontal insulation stripping position until the desired lengths stripped of insulation are achieved for both cable ends. As soon as the drawing-off grippers 11, 12 are positioned in the correct horizontal insulation-stripping position the stroke element 6 can be lowered again through a short path corresponding with the incision depth for the stripping of insulation. This working position is illustrated in FIG. 10. As evident from the detail illustration, which corresponds with FIG. 10, in accordance with FIG. 15, the insulation stripping knives 29, 30 and 31, 32 should cut into the insulation only to such an extent that they do not contact the strands or conductors of the cable. The insulation stripping process is subsequently concluded in that the pieces of insulation cut into are drawn off the cable ends. This is executed by means of the drawing-off grippers 11, 12. Through movement of the drawing-off gripper 11 and thus of the cable piece 7' in f-direction the insulation is removed at the rear end of the cable piece 7'. Through movement of the drawing-off gripper 12 and thus of the rest of the cable 7 in opposite direction (arrow f) the insulation is removed at the front end of the rest of the cable 7. Directly subsequently, the drawing-off grippers 11, 12 are again moved away from one another until the two cables 7, 7' or the ends thereof are disposed correctly in position above the crimp contacts (FIG. 11). Thereafter, the drive unit with the eccentric shaft is again activated and the stroke element 6 is lowered again for performing the crimping process. FIG. 12 shows the cable processing apparatus 1 with the completely lowered stroke element (crimp setting) in which the crimp pressing is concluded. In this setting the eccentric shaft is disposed in or at least in the vicinity of the bottom dead center of the eccentric shaft. In this working step the cable ends are moved into the correct vertical position, which is undertaken with the help of the lowering devices (not illustrated here). After the conclusion of the crimping process the stroke element 6 moves back into the start setting (FIG. 13). The drawing-off grippers 11, 12 are in that case led vertically back into the start position by spring action.

Figure 14:
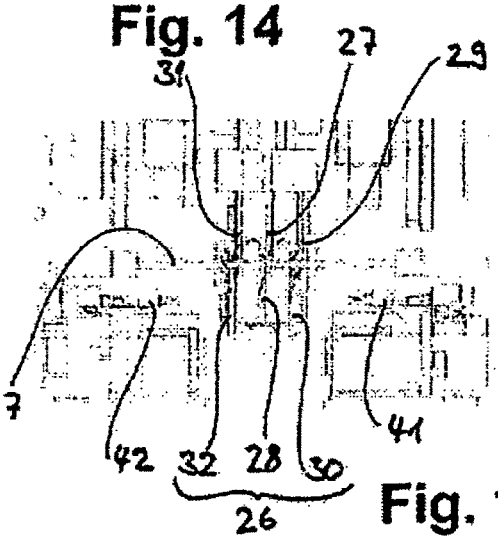
FIG. 14 shows a detail illustration, to enlarged scale, of the cable processing apparatus of FIG. 9.
Figure 15:
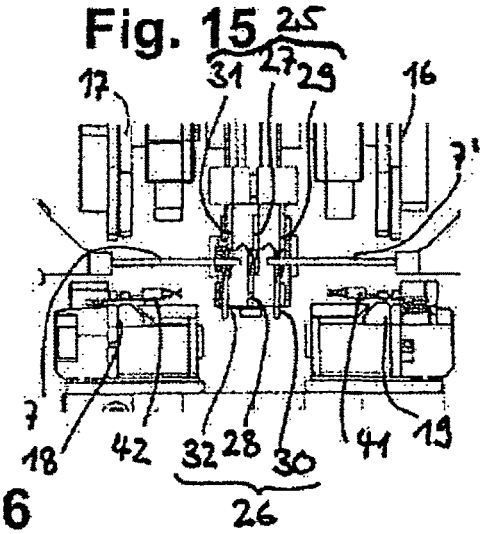
FIG. 15 shows a detail illustration, to enlarged scale, of the cable processing apparatus according to FIG. 10

FIGS. 14 and 15 show details, to substantially enlarged scale of the cable processing apparatus according to FIGS. 9 and 10. The unit 2 for cutting to length and stripping insulation comprises, for severing the cable 7, mutually opposite upper and lower separating knives 27 and 28. The mutually opposite upper and lower first insulation stripping knives 29, 30 are provided for stripping insulation from the cable piece 7' cut to length by means of the separating knives (FIG. 15). The mutually opposite upper and lower second insulation stripping knives 31, 32 are associated with the residual cable 7. As evident from FIG. 14, the insulating stripping knives 29, 30 and 31, 32 do not contact the cable after conclusion of the severing process. After the deflected cable parts have been moved away from one another to the extent of the desired insulation stripping length, the cable insulation can be cut into by the insulation stripping knives. For stripping insulation the knife units 25 and 26 are moved in opposite sense in s1-direction and s2-direction to the setting for insulation stripping. This movement can be undertaken precisely with the help of the eccentric shaft, so that it is ensured that the insulation stripping knives do not contact the conductor of the cable.

In departure from the afore-described method it would also be conceivable to not crimp the two cable ends simultaneously, so as to be able to achieve different crimp heights. For example, the trailing cable could initially be crimped by itself, in that beforehand the leading cable piece cut to length was moved back by means of the drawing-off gripper to such an extent that the end of the trailing cable lies outside the range of action of the crimping tool. The cable piece produced to finished state with the rear end furnished with the crimp contact could thereafter be deposited. At the same time or subsequently the leading cable end, which is not yet crimped, could be processed to finished state. The two contact advancing units would in that case have to be programmed so that the crimp contacts would be pushed on only immediately prior to the crimping, since in each case a crimping tool would have to execute an idle stroke.

Figure 16:
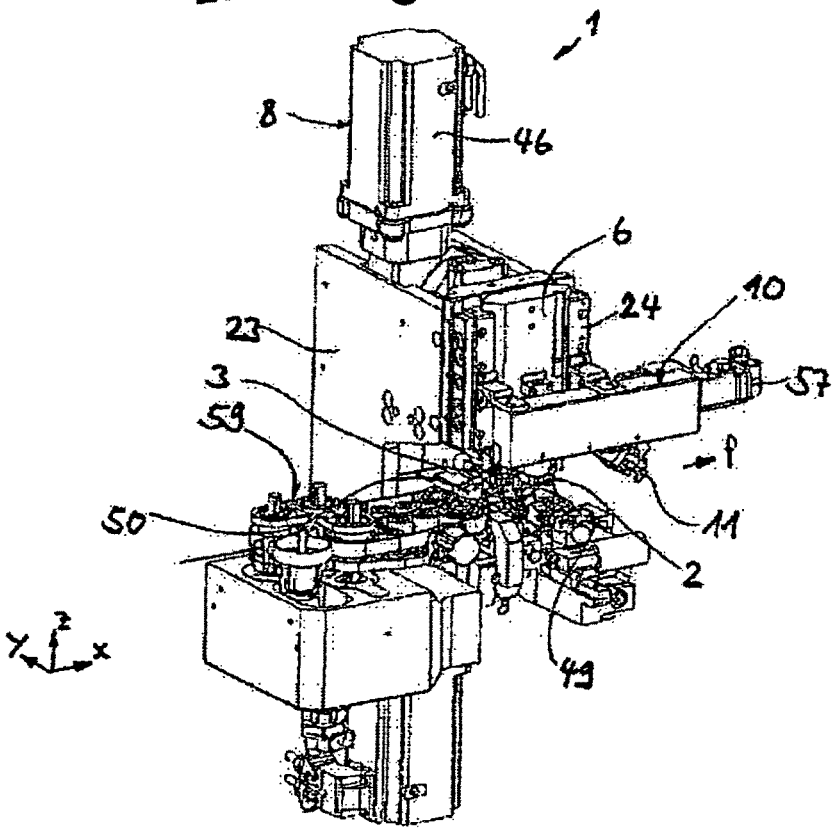
FIG. 16 shows a perspective illustration of a cable processing apparatus according to an alternative embodiment.

FIG. 16 shows an arrangement with cable processing apparatus 1 having different conveying means for feeding the cable 7 to the cable processing apparatus. Instead of the cable being gripped at the entry side by means of withdrawal grippers and being withdrawn to the deflection position as in the preceding embodiment, the present arrangement has a belt drive 59. The maximum possible cable length would thus no longer be restricted by the travel of the withdrawal gripper. If the belt drive is placed near the drive unit, a drawing-off gripper could even be omitted, since the drawing-off movement for the front cable end of the rest of the cable could be performed by the belt drive.

In the preceding embodiments, cable processing apparatus was described in which one cable is fed and processed. However, in principle, it would also be conceivable to process several cables simultaneously or in parallel by identical cable processing apparatus only slightly changed. For that purpose, the crimping tools could be designed in such a way that, for example, in each instance two or more crimp contacts are crimped by one stroke. The unit for cutting to length and stripping insulation would in this case have a corresponding number of knives.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A cable processing apparatus for cutting a cable to length and stripping insulation therefrom and for fitting out the cable with crimp contacts, comprising:

a unit for cutting a cable to length and stripping insulation from the cable having at least one knife for cutting through the cable, for stripping insulation from a rear end of a cable piece cut to length by the at least one knife and for stripping insulation from a front end of a remainder of the cable;

a crimping press having a first crimping tool for connecting the rear end of the cable piece with a first crimp contact and a second crimping tool for connecting the front end of the remainder of the cable with a second crimp contact; and a stroke element operatively connected to the unit for cutting to length and stripping insulation and the first and second crimping tools of the crimping press, said stroke element movable in a vertical direction relative to a horizontal axis along which the cable extends, wherein the unit for cutting to length and stripping insulation and at least one of the first crimping tool and the second crimping tool are operated by movement of the stroke element in the vertical direction to respectively perform at least two of cutting through the cable and removing insulation from the rear end and the front end, crimping the first crimp contact on the rear end of the cable piece, and crimping the second crimp contact on the front end of the remainder of the cable.

2. The cable processing apparatus according to claim 1 wherein all of the unit for cutting to length and stripping insulation, the first crimping tool and the second crimping tool of the crimping press are operated by the stroke element.

3. The cable processing apparatus according to claim 1 wherein the first crimping tool and the second crimping tool each include a movable upper tool, wherein the upper tools are fastened to the stroke element.

4. The cable processing apparatus according to claim 3 wherein the stroke element includes two lateral tool mounts into which the upper tools are inserted from opposite sides of the stroke element.

5. The cable processing apparatus according to claim 1 wherein the stroke element includes a carriage vertically displaceably mounted on a machine housing of the cable processing apparatus by a guide arrangement.

6. The cable processing apparatus according to claim 1 wherein the cable is transported along the horizontal axis by the cable processing apparatus and the unit for cutting to length and stripping insulation as well as the first crimping tool and the second crimping tool of the crimping press are arranged in succession along the horizontal axis.

7. The cable processing apparatus according to claim 1 including a motor-drivable eccentric shaft by which the stroke element is reciprocatingly moved between a start setting and a crimping setting.

8. The cable processing apparatus according to claim 1 wherein the unit for cutting to length and stripping insulation includes at least one separating knife for severing the cable, at least one first insulation stripping knife for stripping the insulation from the rear end of the cable piece and at least one second insulation stripping knife for stripping the insulation from the front end of the remainder of the cable.

9. The cable processing apparatus according to claim 8 wherein the unit for cutting to length and stripping insulation includes mutually opposite upper and lower separating knives for severing the cable and mutually opposite upper and lower first insulation stripping knives and mutually opposite upper and lower second insulation stripping knives for stripping insulation from the cable, wherein the respective upper and lower separating knives or insulation stripping knives are movable in opposite sense with respect to one another.

10. The cable processing apparatus according to claim 9 wherein an upper knife unit includes the upper separating knife, the upper first insulation stripping knife and the upper second insulation stripping knife and is connected with the stroke element, and a lower knife unit includes the lower separating knife, the lower first insulation stripping knife and the lower second insulation stripping knife and is connected with the stroke element by a transmission whereby on lowering of the upper knife unit by the stroke element the lower knife unit is raised.

11. The cable processing apparatus according to claim 1 including a withdrawal gripper movable along the horizontal axis for transporting the cable at an entry side to a position for cutting to length.

12. The cable processing apparatus according to claim 1 including two drawing-off grippers by which respective parts of the rear end and the front end which have not been stripped of insulation are gripped and moved for stripping the insulation.

13. The cable processing apparatus according to claim 12 wherein a first of the drawing-off grippers is associated with the rear end of the cable piece and a second one of the drawing-off grippers is associated with the front end of the remainder of the cable, the first and second drawing-off grippers forming a drawing-off unit fastened to a machine housing of the cable processing apparatus.

14. The cable processing apparatus according to claim 12 wherein the two drawing-off grippers are reciprocatingly movable along the horizontal axis by separate motors.

15. The cable processing apparatus according to claim 12 including lowering devices configured to vertically position the rear end and the front end in the crimping press being arranged at the stroke element, wherein the drawing-off grippers gripping the respective parts of the rear end and the front end which have not been stripped of insulation are moved between a start setting and a crimping setting by the lowering devices when the stroke element is moved.

* * * * *